US010787023B2

(12) United States Patent
Brand et al.

(10) Patent No.: US 10,787,023 B2
(45) Date of Patent: Sep. 29, 2020

(54) WRITING IMPLEMENT WITH MAGNETIC COMPONENT

(71) Applicant: CRAYOLA, LLC, Easton, PA (US)

(72) Inventors: Douglas A. Brand, Easton, PA (US); Thomas R. Rau, Easton, PA (US); Gregory R. Nungester, Asbury, NJ (US)

(73) Assignee: CRAYOLA LLC, Easton, PA (US)

( * ) Notice: Subject to any disclaimer, the term of this patent is extended or adjusted under 35 U.S.C. 154(b) by 0 days.

(21) Appl. No.: 16/153,119

(22) Filed: Oct. 5, 2018

(65) Prior Publication Data

US 2019/0105941 A1 Apr. 11, 2019

Related U.S. Application Data

(60) Provisional application No. 62/570,281, filed on Oct. 10, 2017.

(51) Int. Cl.

| | |
|---|---|
| ***B43K 23/00*** | (2006.01) |
| ***B43K 27/02*** | (2006.01) |
| ***B43K 21/00*** | (2006.01) |
| ***B43K 8/02*** | (2006.01) |
| ***B43K 23/02*** | (2006.01) |
| ***B43K 29/00*** | (2006.01) |

(52) U.S. Cl.

CPC ..... *B43K 23/001* (2013.01); *B43K 8/02* (2013.01); *B43K 21/006* (2013.01); *B43K 23/02* (2013.01); *B43K 27/02* (2013.01); *B43K 29/00* (2013.01)

(58) Field of Classification Search

CPC ..... B43K 23/001; B43K 23/002; B43K 8/02; B43K 21/006; B43K 23/02; B43K 27/02; B43K 29/00

See application file for complete search history.

(56) References Cited

U.S. PATENT DOCUMENTS

| | | | | |
|---|---|---|---|---|
| 2,790,420 | A * | 4/1957 | Zelinger | B43K 23/001 401/52 |
| 5,022,775 | A * | 6/1991 | Inoue | A45D 34/043 401/107 |
| 5,746,638 | A | 5/1998 | Shiraishi | |
| 6,749,480 | B1 | 6/2004 | Hunts | |
| 7,413,493 | B2 | 8/2008 | Toht et al. | |
| 7,507,136 | B2 | 3/2009 | Patton | |
| 7,527,447 | B2 | 5/2009 | Huang | |
| 7,955,156 | B2 | 6/2011 | Toht et al. | |
| 8,821,057 | B2 | 9/2014 | Lambert | |
| 9,662,926 | B1 * | 5/2017 | Boettcher | B43K 23/001 |
| 2010/0087119 | A1 | 4/2010 | Vicentelli | |
| 2012/0200378 | A1 | 8/2012 | Shannon | |

(Continued)

*Primary Examiner* — J C Jacyna

(74) *Attorney, Agent, or Firm* — Shook, Hardy & Bacon LLP

(57) ABSTRACT

A writing implement having a magnetic component is disclosed. The writing implement may be a pen, pencil, marker, highlighter, or other type of writing implement, and may include a writing tip, a reservoir for providing a writing fluid, a housing, and at least one magnetic component. The magnetic component may be sized and shaped so that it can be at least partially enclosed within the housing. The magnetic component may include one or more magnets and may be movably coupled to the housing to allow for alignment of the magnets with a ferromagnetic surface.

13 Claims, 6 Drawing Sheets

(56) References Cited

U.S. PATENT DOCUMENTS

| | | | | |
|---|---|---|---|---|
| 2014/0227934 | A1 | 8/2014 | Rudisill | |
| 2014/0270899 | A1* | 9/2014 | Davies-Smith | B43K 8/003 401/195 |
| 2017/0087921 | A1* | 3/2017 | Kramer | B43K 8/02 |
| 2017/0259612 | A1* | 9/2017 | Boettcher | B43K 8/02 |

* cited by examiner

WRITING IMPLEMENT WITH MAGNETIC COMPONENT

CROSS-REFERENCE TO RELATED APPLICATIONS AND PRIORITY CLAIM

This Non-Provisional Patent Application claims priority to U.S. Provisional Patent App. No. 62/570,281, filed on Oct. 10, 2017, and titled "WRITING IMPLEMENT WITH MAGNETIC COMPONENT," which is incorporated herein by reference in the entirety.

TECHNICAL FIELD

The field relates to writing implements, such as pens, markers, and the like, that include a magnetic component.

BACKGROUND

Writing implements are sometimes used in circumstances where it is desirable to have the writing implements remain in a particular place, such as against a surface or object. This may be desirable for ease of access, storage, transportation, enjoyment, or for another reason. As a result, a writing implement that can be magnetically attached to a surface or object is desired.

SUMMARY

This summary is intended to introduce a selection of concepts in a simplified form that are further described below in the detailed description section of this disclosure. This summary is not intended to identify key or essential features of the disclosed subject matter, and it is not intended to be used as an aid in isolation to determine the scope of the claimed subject matter.

In brief, and at a high level, this disclosure describes, among other things, a writing implement having one or more magnetic components that allow the writing implement to be magnetically attached to a surface or object. The writing implement may be a pen, pencil, marker, highlighter, or other type of writing implement, and may include a writing tip, a reservoir for providing a writing fluid to the writing tip, a housing, and a magnetic component. The housing may be elongated and/or cylindrical, and the magnetic component may be sized and shaped to be at least partially enclosed or encased within the housing. Additionally, the magnetic component may include one or more magnets, and may be movably coupled to the housing to allow the magnets to move freely relative to the housing. The magnets are therefore able to self-orient based on attraction to a nearby ferromagnetic surface or object, facilitating magnetic attachment to the same.

In one embodiment, a writing implement is provided. The writing implement comprises a housing comprising a first end and a second end, a writing tip coupled to the first end of the housing, and a magnetic component at least partially enclosed within the housing. The magnetic component is movably coupled to the housing.

In another embodiment, a magnetic writing implement is provided. The magnetic writing implement comprises a housing having a first end and an opposite second end, a writing tip coupled to the first end of the housing, a reservoir coupled to the writing tip and enclosed at least partially within the housing, and a magnetic component at least partially enclosed within the housing. The at least one magnet is freely rotatable about an axis of the housing.

In another embodiment, a method of manufacturing a magnetic writing implement is provided. The method comprises attaching a writing tip to a reservoir containing a writing fluid, attaching the writing tip to a first end of a housing, and positioning a magnetic component comprising at least one magnet at least partially within the housing, such that the magnetic component is movably coupled to the housing.

The term "writing implement" as used herein is intended to encompass any type of writing device or tool, such as a pencil, pen, marker, highlighter, etc., including one that uses visible or conditionally visible ink (e.g., black-light ink), and also one that is multi-functional (e.g., including both a pen and a pencil, etc.). These examples of writing implements are intended to be exemplary and non-limiting, and other styles, configurations, and combinations of writing implements are contemplated as within the scope hereof.

BRIEF DESCRIPTION OF THE DRAWINGS

The subject matter of this disclosure is described with reference to the attached drawing figures, which are intended to provide non-limiting examples of the disclosed subject matter, wherein.

DETAILED DESCRIPTION

The subject matter of this disclosure is described with specificity herein to meet statutory requirements. However, this description is not intended to limit the scope of this invention. Rather, the claimed subject matter may be embodied in other ways, to include different steps, combinations of steps, features, and/or combinations of features, similar to those described herein and in conjunction with other present or future technologies. Moreover, although the terms "step"

or "block" may be used herein to identify different elements of methods employed, the terms should not be interpreted as implying any particular order among or between steps or blocks except when an order is explicitly described and required.

The subject matter of this disclosure relates to writing implements having one or more magnetic components integrated therein. The magnetic components allow the writing implements to be magnetically attracted and/or attached to ferromagnetic surfaces and objects. The writing implements can therefore be placed at certain desired locations (e.g., against a metal surface) based on magnetic attraction. One exemplary writing implement comprises a writing tip, a housing, a reservoir, and a magnetic component. The magnetic component may be incorporated, attached, and/or otherwise enclosed within the housing to minimize interference with the writing functionality of the writing implement. Exemplary writing implements, as well as methods of manufacturing and/or using the same, are discussed in further detail below with respect to FIGS. 1-8.

Figure 1:
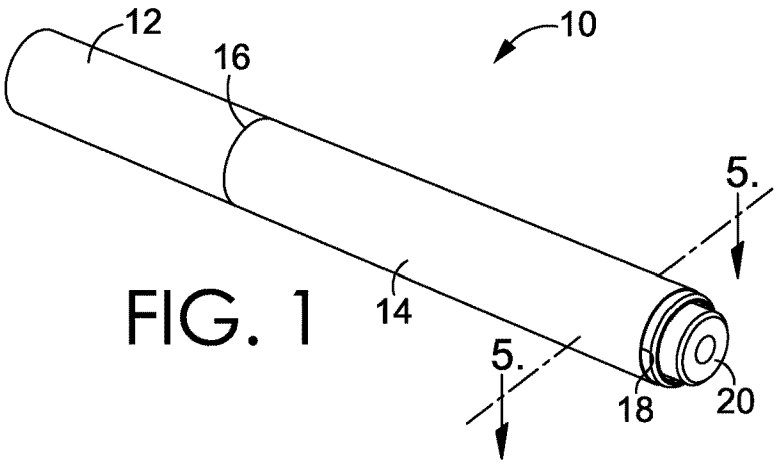
FIG. 1 depicts a non-exploded view of an exemplary writing implement that includes a magnetic component, in accordance with an embodiment hereof.

Referring initially to FIG. 1, a non-exploded view of an exemplary writing implement 10 is provided, in accordance with an embodiment hereof. The writing implement 10 is depicted as a marker, but could be another type of writing implement. The writing implement 10 includes a cap 12, a housing 14 having a first end 16 and a second end 18, and an end plug 20 that is secured to the housing 14. The housing 14 depicted in FIG. 1 is an elongated cylinder that includes an interior cavity 22 (shown in FIG. 2) within which a magnetic component 24 and a reservoir 26 may be at least partially enclosed or encapsulated (also shown in FIG. 2).

Figure 2:
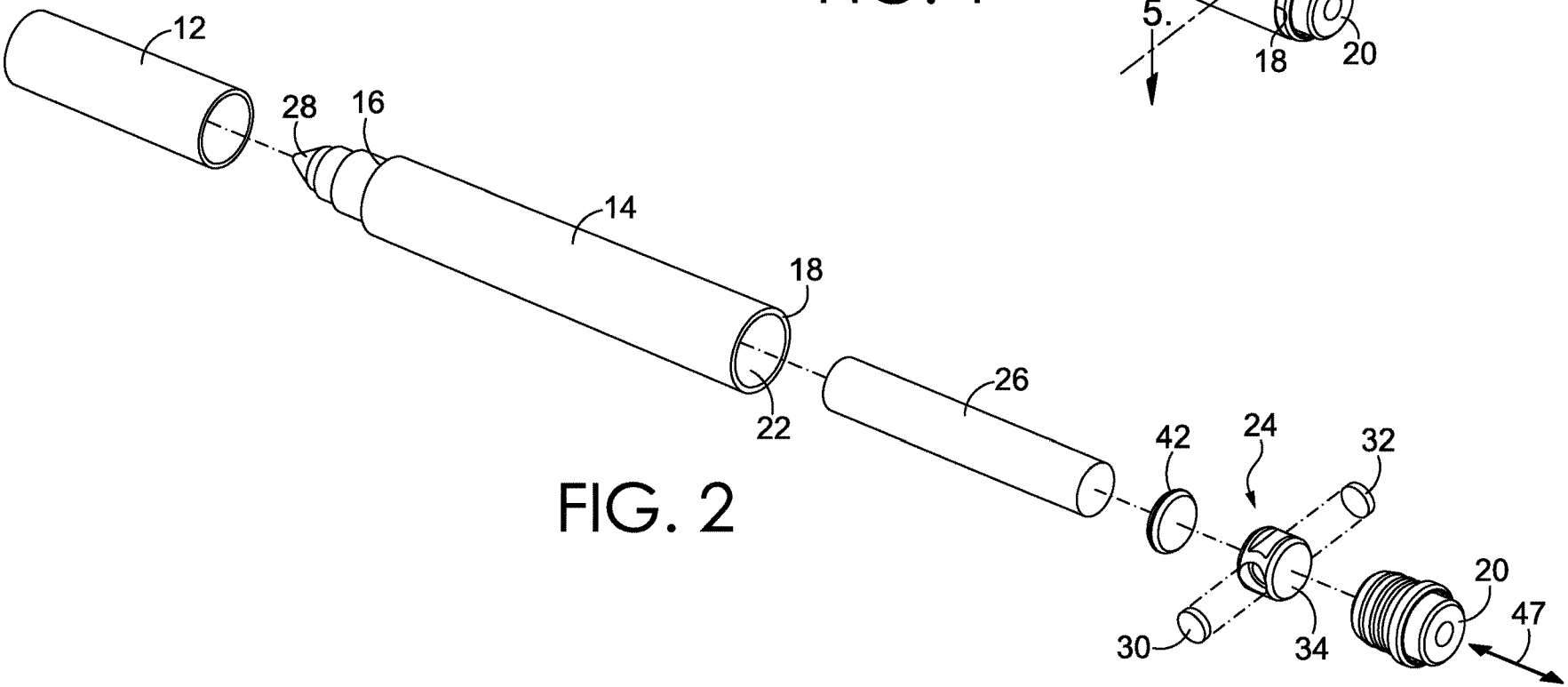
FIG. 2 depicts an exploded view of the writing implement of FIG. 1, in accordance with an embodiment hereof.

Referring to FIG. 2, the writing implement 10 of FIG. 1 is depicted in exploded form, in accordance with an embodiment hereof. FIG. 2 additionally depicts a writing tip 28 (e.g., a pen or marker tip through which an ink is dispersed onto a writing surface) that is coupled to the reservoir 26, which supplies a writing fluid to the writing tip 28. In alternative aspects, the writing fluid may not be provided from a reservoir enclosed within the writing implement, such as the reservoir 26, but rather may be stored and provided using a "free ink" system, in which the writing fluid is enclosed within the writing implement but not housed in a specific reservoir. Back to FIG. 2, the magnetic component 24 includes a first magnet 30 and a second magnet 32 coupled to a magnet holder 34. The magnetic component 24 may be integrally built into the writing implement 10, or may be a separately formed piece that is integrated into the writing implement 10 in any number of ways. The writing implement 10 further includes a spacer 42 that separates the magnetic component 24 from the reservoir 26. The end plug 20 can be secured to the second end 18 of the housing 14 to at least partially enclose or encapsulate the magnetic component 24 within the housing 14 when the writing implement 10 is assembled, as shown in FIG. 1. The magnetic component 24 may also be movably coupled within the housing 14 to allow movement of the first and second magnets 30, 32 relative to the housing 14 (e.g., to allow the magnets 30, 32 to self-orient based on attraction to a ferromagnetic surface or object).

The magnetic component 24 may be movably coupled to the housing 14 in different ways. For example, the magnetic component 24 may be directly movably coupled to the housing 14 (e.g., with a fixed part-to-part connection, such as, for example, an axle), or instead, may simply be movably enclosed by components of the writing implement 10, such as the end plug 20, the spacer 42, and the housing 14, with a sufficient amount of frictional tolerance to allow for a desired freedom-of-movement of the magnets 30, 32 within the housing 14 (e.g., a desired degree of rotation about an axis 47 of the writing implement 10/housing 14).

In FIGS. 1-2, it is depicted that the magnetic component 24 is internal to the writing implement 10 when the writing implement 10 is in assembled form. However, in other embodiments, some or all of the magnetic component 24 and/or the magnets 30, 32 may be exposed or external to the writing implement 10. Additionally, in some aspects, the housing 14 may be at least partially transparent or opaque, allowing the magnetic component 24 and/or the magnets 30, 32 thereof to be at least partially visible. The magnetic component 24 may be positioned at any location along the axis 47 of the housing 14, and is not limited to the axial location shown in FIG. 2. Additionally, although a single magnetic component 24 is depicted with the writing implement 10 shown in FIG. 2, it should be noted that multiple magnetic components may be utilized in additional embodiments. Magnetic components that are movably coupled to the housing 14 or that are fixed relative to the housing 14 are also contemplated herein.

Figure 4:
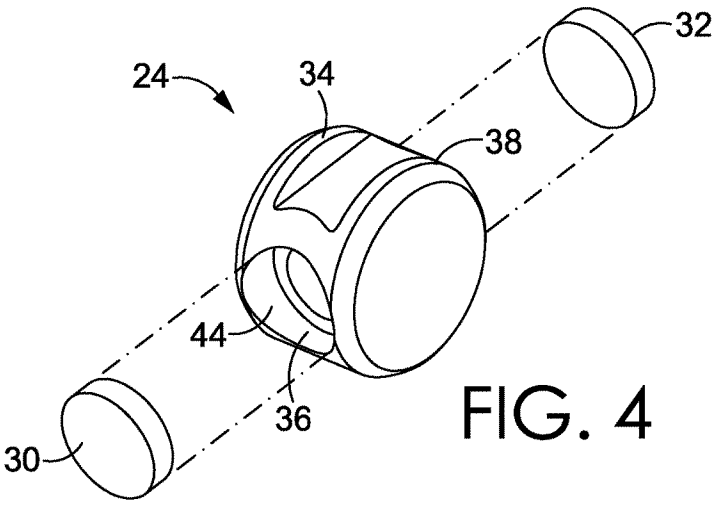
FIG. 4 depicts an exploded view of the magnetic component of FIG. 3, in accordance with an embodiment hereof.
Figure 3:
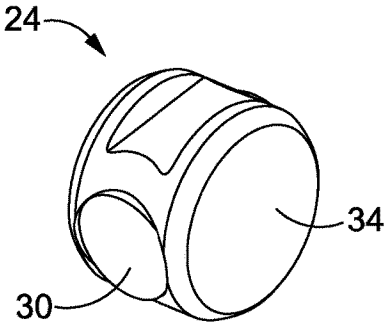
FIG. 3 depicts a non-exploded view of an exemplary magnetic component for use with a writing implement, in accordance with an embodiment hereof.

Referring to FIGS. 3 and 4, a non-exploded and an exploded view of the magnetic component 24 depicted in FIG. 2 is provided, in accordance with an embodiment hereof. The magnetic component 24 includes the first magnet 30 and the second magnet 32, which are coupled to a magnet holder 34. The first magnet 30 is coupled to the magnet holder 34 at a first location 36 (i.e., at a first indentation 44 sized and shaped to receive the first magnet 30). The second magnet 32 is coupled to the magnet holder 34 at a second location 38 (i.e., at a second indentation, obscured in FIGS. 3-4, sized and shaped to receive the second magnet 32). The second location 38 is located generally on an opposite side of the magnet holder 34 as the first location 36. It should be noted that although the magnet holder 34 shown in FIGS. 3-4 is configured for mounting two magnets 30, 32, in other embodiments, a magnet holder may be configured for mounting one, three, four, or another number of magnets in circumferential fashion or in axial fashion. Furthermore, in other embodiments, one or more magnets may simply be incorporated into a writing implement with no magnet holder at all, or with a magnet holder of a different size, shape, or configuration than the magnet holder 34 shown in FIGS. 3-4.

FIG. 3 depicts a non-exploded view of the magnetic component 24, which is sized and shaped to fit at least partially within the writing implement 10 shown in FIGS. 1-2. FIG. 4 depicts the magnetic component 24 with the first magnet 30 moved out from its corresponding first location 36 on the magnet holder 34 and the second magnet 32 moved out from its corresponding (obscured) second location 38 on the magnet holder 34. The first location 36 includes the first indentation 44 which may be sized and shaped to receive the magnet 30 and/or frictionally and/or magnetically hold it in place. The second location 38 may include a similar indentation, which is not shown due to it being obscured. The magnetic component 24 allows the magnets 30, 32 to be movably coupled within the housing 14 of the writing implement 10, allowing them to freely rotate 360 degrees about the axis 47 of the housing 14. This allows the magnets 30, 32 to self-align, or rather, move into a position that aligns one or more of the magnets with a surface or object to which the one or more magnets are magnetically attracted.

Figure 5:
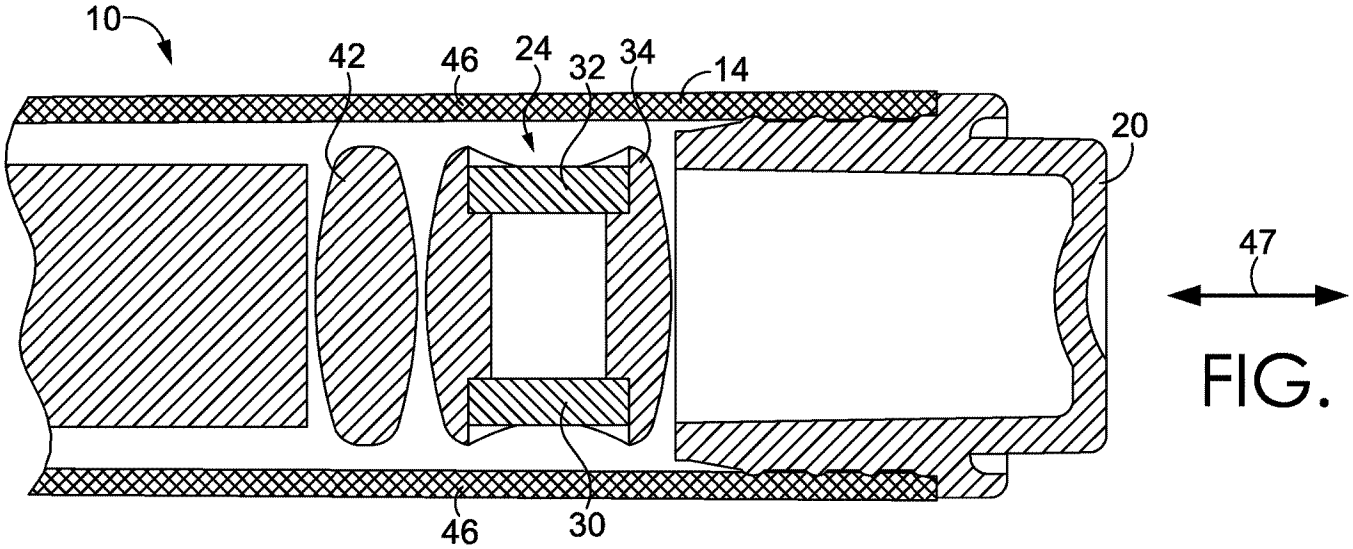
FIG. 5 depicts a partial cross-section view of the writing implement of FIG. 1, in accordance with an embodiment hereof.

Referring to FIG. 5, a partial cross-section view of the writing implement 10 depicted in FIGS. 1-2 is provided, in accordance with an embodiment hereof. FIG. 5 further depicts how the end plug 20, the one or more walls 46 of the housing 14, and the spacer 42 at least partially enclose or encapsulate the magnetic component 24 within the writing implement 10, but still allow the magnetic component 24 to remain movable relative to the writing implement 10 (i.e., rotatable about the axis 47). In other words, based on the configured movement tolerance and frictional engagement between the magnetic component 24 and the surrounding components of the writing implement 10, the magnets 30, 32 are able to rotate about an axis 47 of the housing 14 to allow the magnets 30, 32 to be oriented towards a magnetic field of a ferromagnetic surface to which the writing implement 10 is to be attached.

Figure 6B:
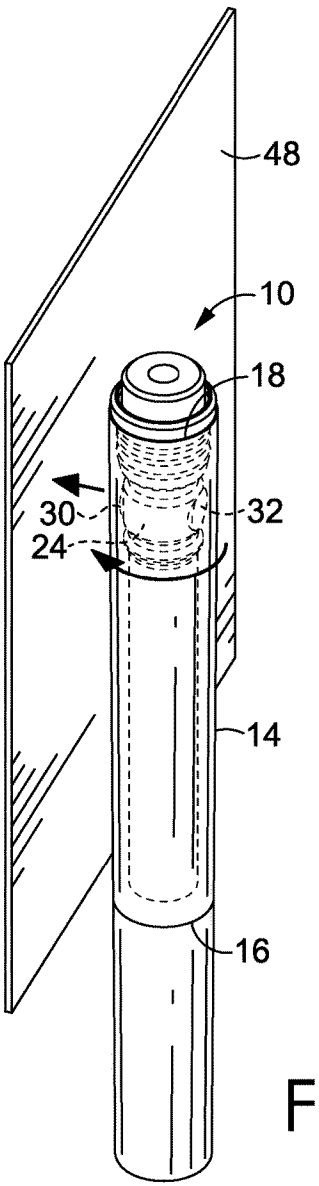
FIGS. 6A-6B depict the writing implement of FIGS. 1-2 with the magnetic component orienting towards a ferromagnetic surface due to magnetic attraction, in accordance with embodiments hereof.
Figure 6A:
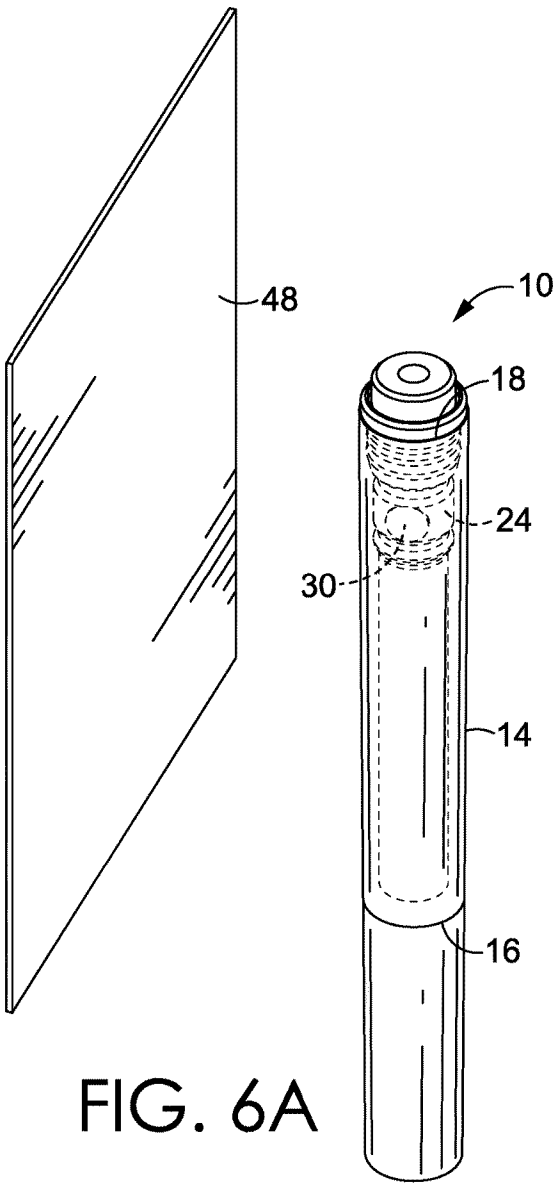

Referring to FIGS. 6A-6B, the writing implement 10 of FIGS. 1-2 with the magnetic component 24 orienting towards a surface 48 due to magnetic attraction is provided, in accordance with an embodiment hereof. In FIG. 6A, the writing implement 10 is positioned close to the surface 48, which may be ferromagnetic (i.e., a material that is attracted to a magnet). As the writing implement 10 gets closer to the surface 48, the magnetic attraction increases between the surface 48 and at least one of the magnets 30, 32. This increase in magnetic attraction moves (i.e., rotates) the magnets 30, 32, aligning the first magnet 30 with the surface 48. FIG. 6B depicts the magnetic attraction between the surface 48 and the re-oriented first magnet 30, which allows magnetic attachment of the writing implement 10 to the surface 48. It should be noted that different configurations allow for different types of attachment. For example, in another aspect, the writing implement 10 may have another magnetic component located near the first end 16 of the housing 14 to permit the first end 16 to be attached to the surface 48, so that it is not free hanging as shown in FIGS. 6A-6B.

Figure 7:
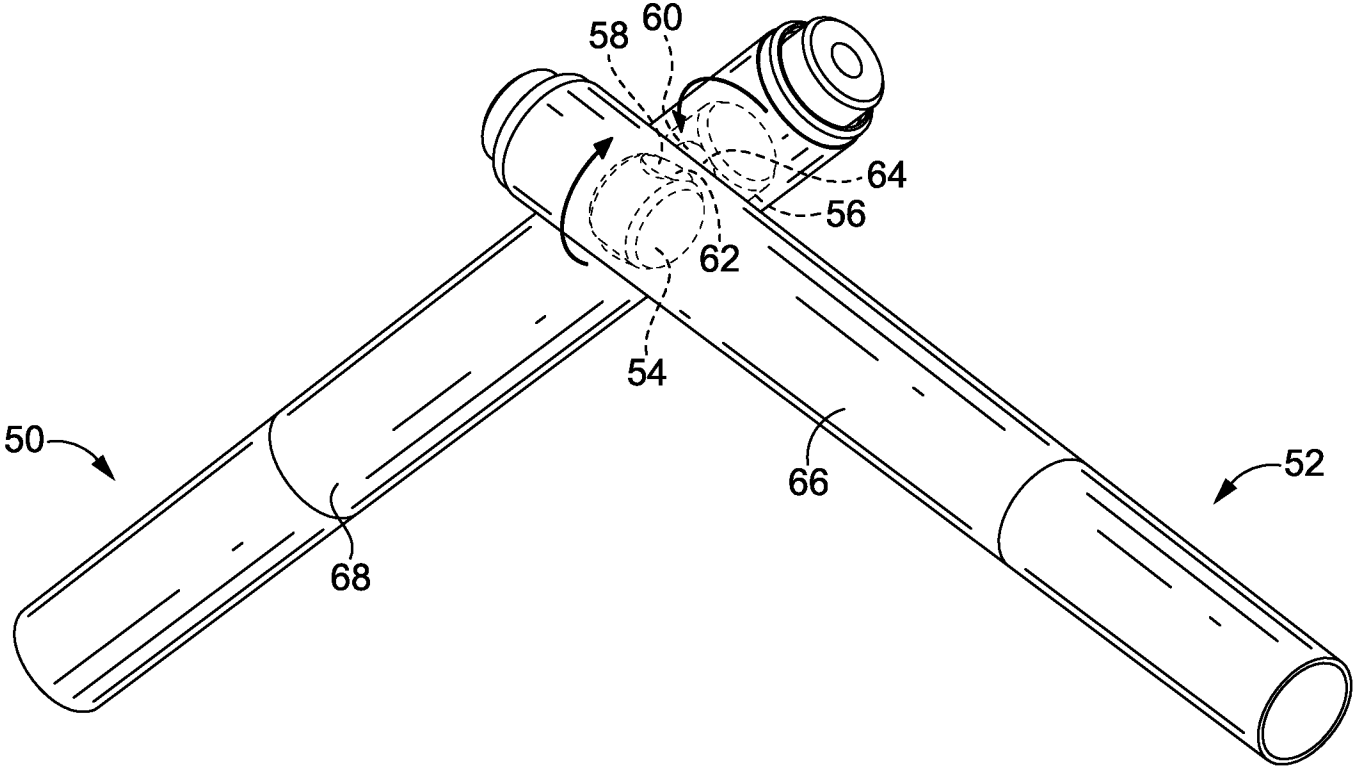
FIG. 7 depicts a pair of writing implements similar to the writing implement of FIGS. 1-2 magnetically attached to each other, in accordance with an embodiment hereof.

Referring to FIG. 7, a pair of writing implements 50, 52, which are similar to the writing implement 10 shown in FIGS. 1-2, magnetically attached to each other, is provided, in accordance with an embodiment hereof. In FIG. 7, each writing implement 50, 52 includes a respective magnetic component 54, 56. Each magnetic component 54, 56 includes a respective magnet 58, 60 with a north and south polarity. For the purposes of clarity, one magnet is shown in each magnetic component 54, 56 in FIG. 7, but in other aspects, multiple magnets may be used in each, such as to provide different outward-facing polarities for attraction to other magnets. In FIG. 7, the magnets 58, 60 are positioned on the magnetic components 54, 56 such that each has an opposite polarity facing outward. When the opposite polarities of the magnets 58, 60 are moved into magnetic proximity (i.e., within each other's magnetic fields), the attraction of the magnets 58, 60 to each other can rotate the respective magnetic components 54, 56 to align surfaces 62, 64 of the magnets 58, 60 to provide a magnetic attachment. Once again, as shown in FIG. 7, the magnetic components 54, 56 are enclosed within respective housings 66, 68 of the writing implements 50, 52 and are movably (i.e., rotatably) coupled to the housings 66, 68.

Figure 8:
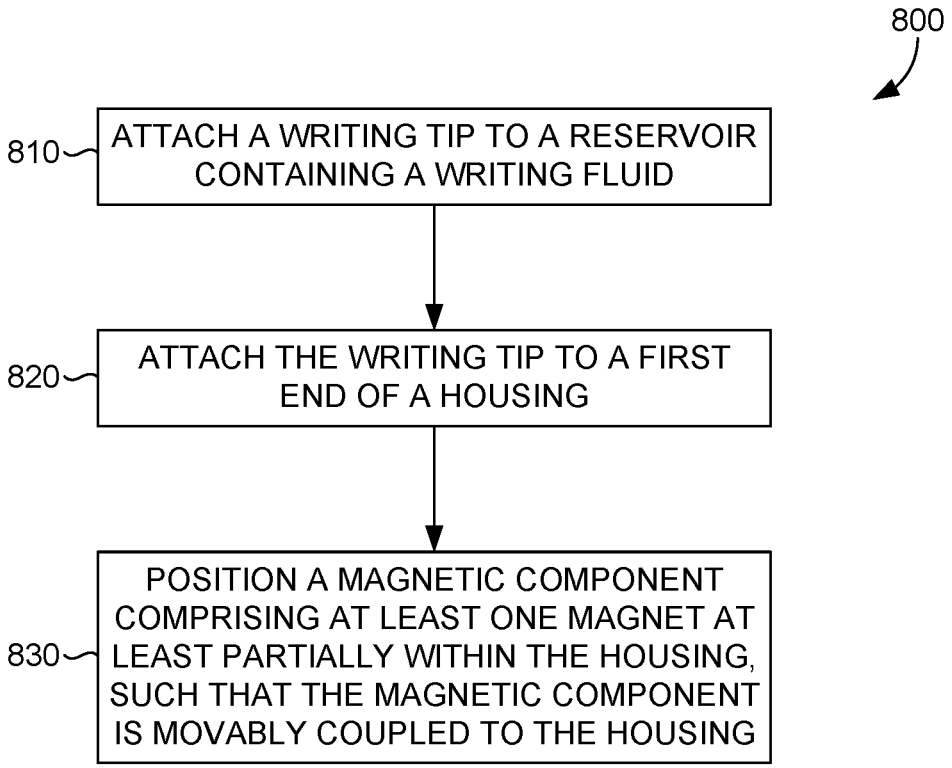
FIG. 8 depicts a flow diagram of an exemplary method of manufacturing a writing implement with a magnetic component, in accordance with an embodiment hereof.

Referring to FIG. 8, a block diagram of an exemplary method 800 of manufacturing a magnetic writing implement is provided, in accordance with an embodiment hereof. At block 810, a writing tip, such as the writing tip 28 depicted in FIG. 2, is attached to a reservoir, such as the reservoir 26 depicted in FIG. 2, containing a writing fluid (e.g., ink). At block 820, the writing tip is attached to a first end of a housing, such as the first end 16 of the housing 14 depicted in FIG. 2. At block 830, a magnetic component, such as the magnetic component 24 depicted in FIG. 2, comprising at least one magnet, such as the first magnet 30 and the second magnet 32 depicted in FIG. 2, is positioned at least partially within the housing, such that the magnetic component is movably coupled to the housing (e.g., rotatably coupled). The magnetic component may also be able to move axially along the housing.

Figure 9:
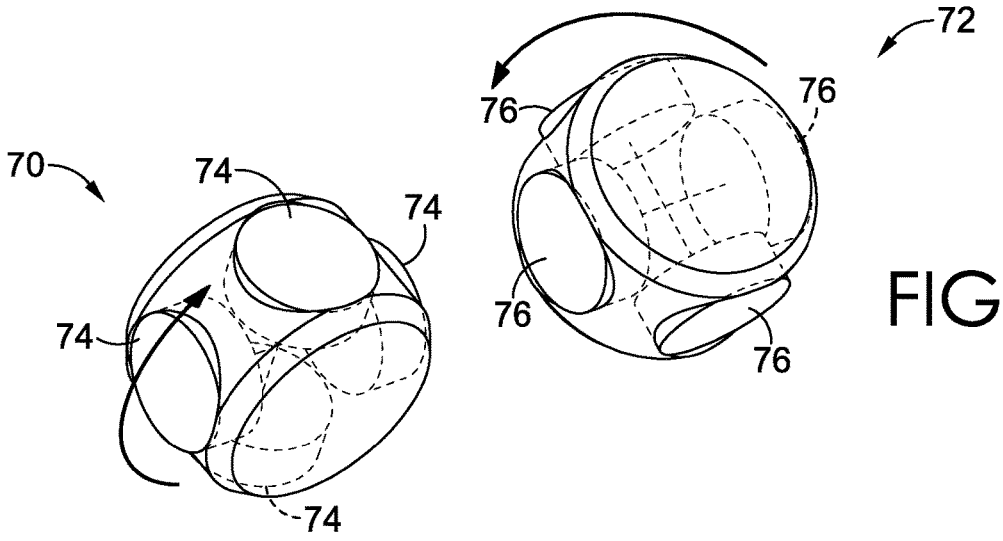
FIG. 9 depicts a pair of disk-shaped magnet holders each having four magnets positioned about the respective disc, in accordance with embodiments hereof.

Referring to FIG. 9, a pair of disk-shaped magnet holders 70, 72 each having four magnets 74, 76 secured thereon is provided, in accordance embodiments hereof. The magnets 74, 76 are positioned circumferentially about the respective disc-shaped magnet holders 70, 72. Each magnet holder 70, 72 may form part or all of a magnetic component that is integrated into a writing implement to impart magnetic attachment functionality to the writing implement. In the aspect shown in FIG. 9, each disc-shaped magnet holder 70, 72 includes four quadrants, each associated with a respective one of the magnets 74 or 76. The magnets 74, 76 may be oriented such that opposite north and south poles are facing radially outward on alternating quadrants, allowing the magnet holders 70, 72, when rotated, to align the magnetic pole of one magnet with a ferromagnetic surface or an opposite magnetic pole of another magnet. In FIG. 9, four magnets are shown, but more or fewer may be utilized in other aspects.

Figure 10A:
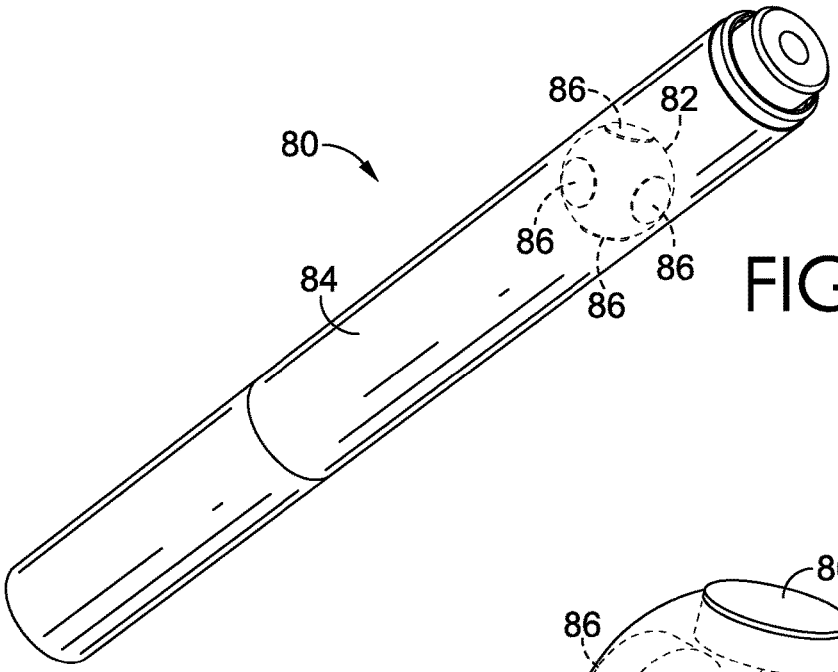
FIG. 10A depicts a writing implement having a spherical magnetic component enclosed therein, in accordance with an embodiment hereof.

FIG. 10A depicts a writing implement 80 with a spherical magnetic component 82 movably enclosed within a housing 84 of the writing implement 80, in accordance with an embodiment hereof. In the aspect depicted in FIG. 10A, the spherical magnetic component 82 includes six magnets 86 positioned about an outer circumference of the spherical magnetic component 82, with the magnetic poles oriented radially outward. The spherical shape of the magnetic component 82 allows for multi-axis movement within the writing implement 80 (i.e., rotation about multiple axes, such as x, y, and z axes), which provides greater flexibility for aligning the magnets 86 towards an object or surface. The spherical magnetic component 82 may be movably enclosed or attached within the writing implement 80 in the ways described elsewhere herein. For example, the spherical magnetic component 82 may be movably enclosed within the housing 84 between different components or walls of the writing implement 80 with sufficient tolerance to allow for rotational movement.

Figure 10B:
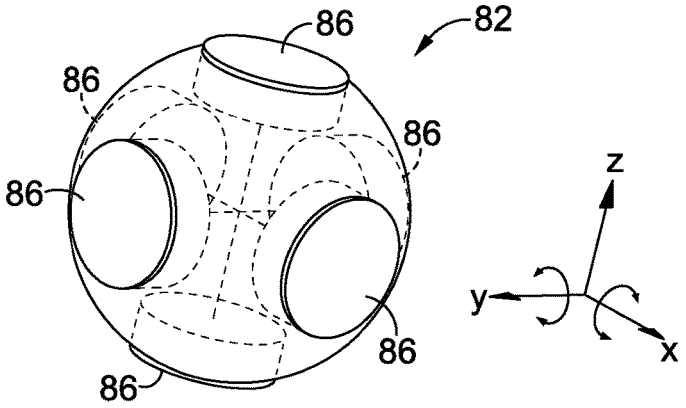
FIG. 10B depicts the spherical magnetic component of FIG. 10A in isolation, in accordance with an embodiment hereof.

FIG. 10B depicts the spherical magnetic component 82 of FIG. 10A in isolation, showing the magnets 86 mounted about the outer circumference of the spherical magnetic component 82, in accordance with an embodiment hereof. The magnets 86 are positioned such that one of the magnetic poles of each magnet 86 faces radially outward from the spherical magnetic component 82. Additionally, the magnetic poles may, in certain aspects, be arranged in alternating or non-consistent fashion (e.g., north pole facing outward, then south pole facing outward, etc.), allowing for different magnetic attractions depending on the orientation of the spherical magnetic component 82. The spherical magnetic component 82 may utilize indentations, adhesives, magnetic attraction, frictional engagement, male-female engagement, or another method of attachment for securing the magnets 86 thereon.

The subject matter of this disclosure has been described in relation to particular embodiments, which are intended in all respects to be illustrative rather than restrictive. Alternative embodiments will become apparent to those of ordinary skill in the art to which the present subject matter pertains without departing from the scope hereof. Different combinations of elements, as well as use of elements not shown, are also possible and contemplated.

What is claimed is:

1. A writing implement, comprising:

a housing comprising a first end, a second end, and a central axis extending through the housing;

a writing tip coupled to the first end of the housing; and a magnetic component comprising at least one magnet, wherein the magnetic component is at least partially enclosed within the housing and is located between the first end and the second end, and wherein the magnetic component is rotatable within the housing and about the central axis of the housing thereby allowing the at least one magnet to change orientation relative to a sidewall of the housing.

2. The writing implement of claim 1, further comprising a reservoir coupled to the writing tip, wherein the housing comprises an elongated cylinder having an interior cavity, and wherein the reservoir is positioned in the interior cavity.

3. The writing implement of claim 2, wherein the magnetic component comprises a magnet holder and a pair of magnets coupled to the magnet holder, and wherein the magnetic component is fully enclosed within the elongated cylinder.

4. The writing implement of claim 3, wherein the magnet holder includes a pair of indentations shaped to respectively receive the pair of magnets.

5. The writing implement of claim 4, wherein the magnetic component is rotatable 360 degrees about the central axis of the housing.

6. The writing implement of claim 5, further comprising a spacer positioned between the reservoir and the magnetic component.

7. The writing implement of claim 1, further comprising an end plug that is attached to the second end of the housing.

8. The writing implement of claim 1, wherein the magnetic component is positioned further towards the second end of the housing than the first end of the housing.

9. The writing implement of claim 1, wherein the writing implement is a pen, a pencil, a marker, or a highlighter.

10. A magnetic writing implement, comprising:

a housing having a first end, a second end, and a central axis extending through the housing;

a writing tip coupled to the first end of the housing;

a reservoir coupled to the writing tip and enclosed at least partially within the housing; and a magnetic component comprising at least one magnet, wherein the magnetic component is at least partially enclosed within the housing and is located between the first end and the second end, and wherein the magnetic component is rotatable within the housing and about the central axis of the housing thereby allowing the at least one magnet to change orientation relative to a sidewall of the housing.

11. The magnetic writing implement of claim 10, wherein the housing comprises an elongated cylinder, wherein the magnetic component comprises a magnet holder, and wherein the at least one magnet comprises a first magnet coupled at a first location on the magnet holder and a second magnet coupled at a second location on the magnet holder.

12. The magnetic writing implement of claim 11, further comprising a spacer positioned between the reservoir and the magnetic component, wherein the magnetic component is freely rotatable 360 degrees about the central axis of the housing, and wherein the first location and the second location are on opposite sides of the magnet holder.

13. The magnetic writing implement of claim 11, further comprising an end plug releasably attached to the second end of the housing, wherein the magnetic component is fully enclosed within the housing.

* * * * *